US012421841B2

(12) United States Patent
Nguyen

(10) Patent No.: US 12,421,841 B2
(45) Date of Patent: Sep. 23, 2025

(54) DOWNHOLE SLEEVES AND MAGNETIC ASSEMBLIES

(71) Applicant: Halliburton Energy Services, Inc., Houston, TX (US)

(72) Inventor: Minh Dang Nguyen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/403,579

(22) Filed: Jan. 3, 2024

(65) Prior Publication Data

US 2025/0215784 A1 Jul. 3, 2025

(51) Int. Cl.
*E21B 47/017* (2012.01)

(52) U.S. Cl.
CPC ..... *E21B 47/017* (2020.05)

(58) Field of Classification Search
CPC ..... E21B 47/017
See application file for complete search history.

(56) References Cited

U.S. PATENT DOCUMENTS 2,589,332 A * 3/1952 Brown ..... F16L 55/10 277/585
2,667,895 A * 2/1954 Pool ..... F16K 15/021 235/201 ME
3,690,163 A * 9/1972 Shannon ..... E21B 47/09 73/152.56
4,855,630 A * 8/1989 Cole ..... H02K 1/278 310/156.28
4,968,185 A 11/1990 Leibhard et al.
5,047,635 A 9/1991 Leaney et al.
5,644,231 A 7/1997 Wignall
6,517,120 B1 * 2/2003 Miyajima ..... F16L 37/0985 285/305
6,630,830 B2 10/2003 Omeragic et al.
6,838,876 B2 1/2005 Kruspe et al.
7,683,613 B2 3/2010 Freedman et al.
8,773,134 B2 * 7/2014 Sorbier ..... E21B 47/017 181/102
10,254,430 B2 4/2019 Fang et al.
2006/0090748 A1 * 5/2006 White ..... F28F 9/20 126/714

(Continued)

FOREIGN PATENT DOCUMENTS

CN 201496002 U 6/2010
CN 220285719 U 1/2024
WO 2009142836 A2 11/2009

OTHER PUBLICATIONS

International Search Report & Written Opinion in PCT/US2024/010527, mailed Nov. 26, 2024.

*Primary Examiner* — D. Andrews
(74) *Attorney, Agent, or Firm* — DeLizio, Peacock, Lewin & Guerra LLP

(57) ABSTRACT

A downhole sleeve includes a cylindrical housing having a hollow interior, the cylindrical housing configured to slide around a component. The downhole sleeve also includes a plurality of protrusions positioned around the cylindrical housing, each protrusion configured to: receive a radially-inward force applied to an exterior surface of the respective protrusion; and transfer the radially-inward force through an interior surface of the respective protrusion to hold the component in position.

16 Claims, 8 Drawing Sheets

(56) References Cited

U.S. PATENT DOCUMENTS

| | | | | |
|---|---|---|---|---|
| 2014/0035413 | A1* | 2/2014 | Cowdry | H02K 5/24 310/91 |
| 2015/0020401 | A1* | 1/2015 | Atkinson | A45D 20/00 34/97 |
| 2018/0309349 | A1* | 10/2018 | Sigmar | B60G 15/02 |
| 2019/0393461 | A1 | 12/2019 | Pare et al. | |

* cited by examiner

DOWNHOLE SLEEVES AND MAGNETIC ASSEMBLIES

BACKGROUND

The present disclosure relates generally to downhole sleeves and magnetic assemblies.

Magnetic assemblies of downhole measurement while drilling (MWD) and logging while drilling (LWD) tools are sometimes adversely affected by downhole vibration. Sometimes, magnets of magnetic assemblies are partially or entirely filled with a magnetic material having a density that is much higher than other components of the MWD/LWD tools, which require a robust mounting scheme. However, some mounting schemes do not account for the density/weight of the magnetic material.

BRIEF DESCRIPTION OF THE DRAWINGS

Illustrative embodiments of the present disclosure are described in detail below with reference to the attached drawing figures, which are incorporated by reference herein, and wherein.

Figure 1:
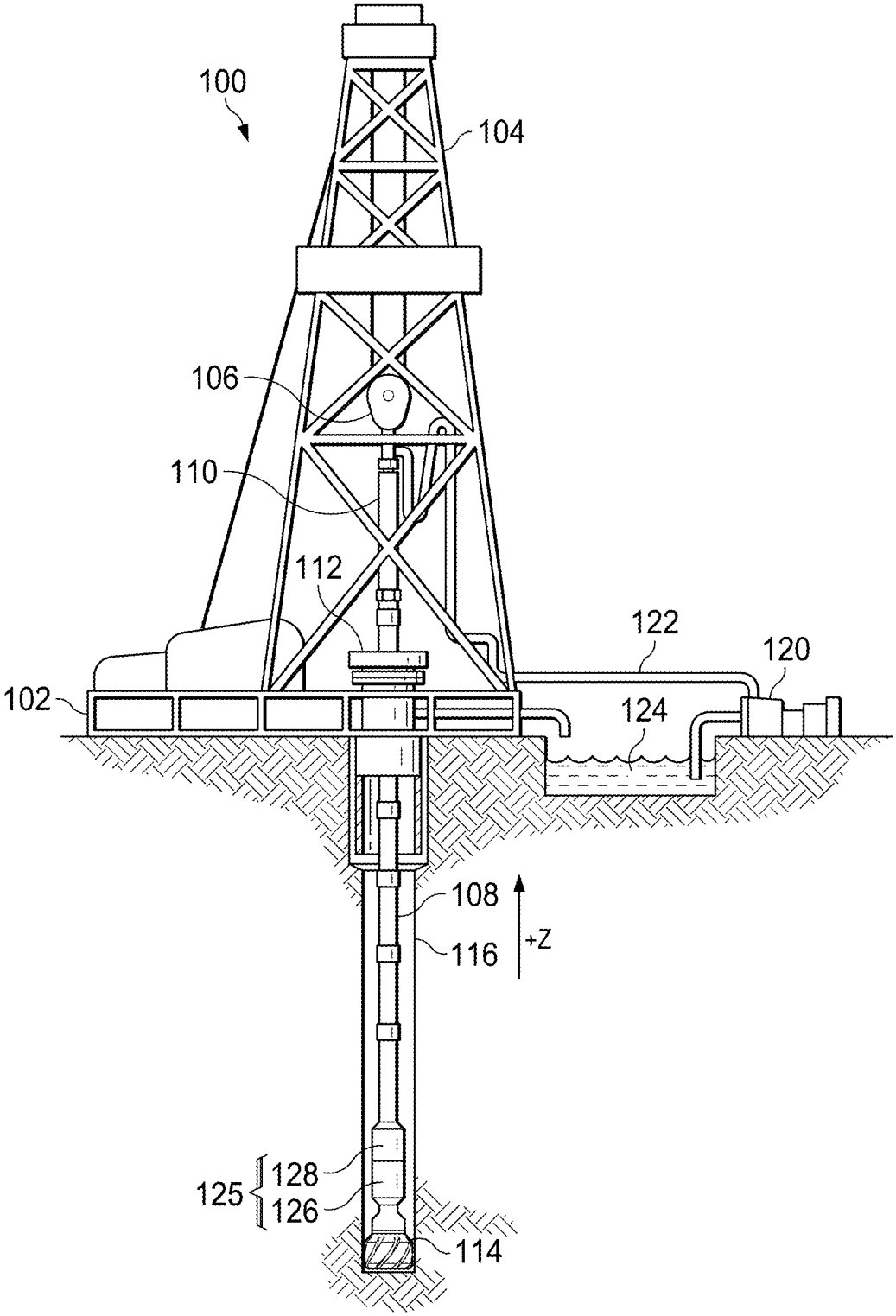
FIG. 1 illustrates a diagrammatic view of an example LWD/MWD wellbore operating environment.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole sleeves and magnetic assemblies. A downhole sleeve has a hollow cylindrical housing that is configured to slide around a downhole apparatus or component. For example, the downhole sleeve is configured to slide around one or more magnets or magnetic assemblies that are in turn positioned around an insert to hold the magnets or the magnetic assemblies in place during one or more downhole operations and prevent unwanted movement of the magnets or magnetic assemblies (e.g., due to vibration) during the downhole operations. The downhole sleeve also has protrusions that are positioned along the cylindrical housing, and configured to receive force/pressure/load, and transfer the force/pressure/load onto the apparatus or component to prevent movement of the apparatus or component. In some embodiments, the protrusions are ribs that are laterally positioned around the cylindrical housing. In some embodiments, the protrusions are dome-shaped structures positioned around the cylindrical housing. In some embodiments, the shape of the protrusions are rectangular, oval, circular, or have irregular shapes. Continuing with the foregoing example, the protrusions are configured to receive an inwardly radial force (e.g., from a collet, clamp, or another component or apparatus configured to generate such force), and transfer the force onto the magnets or magnetic assemblies to hold the magnets or magnetic assemblies in position. In some embodiments, the cylindrical housing and the plurality of protrusions are formed from different materials. In some embodiments, the cylindrical housing is formed from a material or another material that maintains the structural integrity of the downhole sleeve, whereas the protrusions are formed from rubber or another material that permits force to be transferred onto the magnets or the magnetic assemblies without damaging the magnets or the magnetic assemblies.

In some embodiments, the downhole sleeve is a component of a magnetic assembly, which also includes a magnet or magnetic assembly. In some embodiments, the magnetic assembly also includes a collet, or another apparatus or component configured to apply a force to the protrusions to hold the magnet in position during downhole operations. In some embodiments, the downhole sleeve is a component of non-magnetic assemblies and tools, including, but not limited to, non-magnetic assemblies having similar components as the magnetic assemblies described herein, where the downhole sleeve is utilized to hold an insert (magnetic or non-magnetic) or another type of component in place.

In some embodiments, the downhole sleeve is a flexible sleeve having an elastic body that stretches radially outward to secure the downhole sleeve around an insert, and apply a radially-inward force after the downhole sleeve is secured around the insert. In that regard, the elastic body is radially stretched outward to fit the elastic body around the insert. Once the elastic body is positioned around the insert, elastic properties of the elastic body apply a radially-inward force towards the insert. In some embodiments, the insert is fitted with magnets or magnetic assemblies, and the flexible sleeve is then positioned around the insert and the magnets and the magnetic assemblies. In such embodiments, the elastic properties of the elastic body apply a radially-inward force towards the magnets or magnetic assemblies to hold the magnets or magnetic assemblies in position during downhole operations, and to prevent unwanted movement of the magnets or magnetic assemblies (e.g., due to downhole vibrations) during the downhole operations.

The downhole sleeve also has a plurality of cutouts that extend along a curved surface of the elastic body. In some embodiments, the cutouts have diamond or diamond-like shapes that are configured to permit a component (e.g., magnets, magnetic assemblies, or other components) secured by the downhole sleeve a degree of flexibility while securing the component to the insert. In some embodiments, the cutouts form a braided structure to permit a component secured by the downhole sleeve a degree of flexibility while securing the component to the insert. In some embodiments, the shape and structure of the cutouts are configured to reduce a stiffness of the downhole sleeve while restricting movement of components with respect to the insert. In some embodiments, the shape and structure of the cutouts are configured to reduce a rigidity of the downhole sleeve while restricting movement of components with respect to the insert. Additional descriptions of downhole sleeves and magnetic assemblies, and methods to restrain a component of a downhole tool are provided in the paragraphs below and are illustrated in FIGS. 1-5.

Turning now to the figures, FIG. 1 illustrates a diagrammatic view of an exemplary LWD/MWD wellbore operating environment 100 in which the present disclosure may be implemented. As depicted in FIG. 1, a drilling platform 102 is equipped with a derrick 104 that supports a hoist 106 for raising and lowering a drill string 108. The hoist 106 suspends a top drive 110 suitable for rotating the drill string 108 and lowering the drill string 108 through the well head 112. Connected to the lower end of the drill string 108 is a drill bit 114. As the drill bit 114 rotates, the drill bit 114 creates a wellbore 116 that passes through various formations. A pump 120 circulates drilling fluid through a supply pipe 122 to top drive 110, down through the interior of drill string 108, through orifices in drill bit 114, back to the surface via the annulus around drill string 108, and into a retention pit 124. The drilling fluid transports cuttings from the wellbore 116 into retention pit 124 and aids in maintaining the integrity of the wellbore 116. Various materials can be used for drilling fluid, including oil-based fluids and water-based fluids.

As depicted in FIG. 1, LWD/MWD tools (collectively "logging tools") 126 are integrated into the bottom-hole assembly 125 near the drill bit 114. As the drill bit 114 extends to the wellbore 116 through the various formations, logging tools 126 collect measurements relating to various formation properties as well as the orientation of the tool and various other drilling conditions.

In the embodiment of FIG. 1, logging tools 126 includes a magnetic assembly 128 that is also integrated into the bottom-hole assembly 125. Magnetic assembly 128 includes a magnet and a downhole sleeve configured to apply sufficient force to prevent undesirable movement of the magnetic insert without overloading the magnet. More particularly, the downhole sleeve has a cylindrical housing having a hollow interior, and a plurality of protrusions positioned around the cylindrical housing, each protrusion configured to receive a radially-inward force applied to an exterior surface of the respective protrusion, and transfer the radially-inward force through an interior surface of the respective protrusion to hold the magnet in position. Additional descriptions of similar magnetic assemblies and downhole sleeves are provided herein and are illustrated in at least FIGS. 2-4B.

Figure 2A:
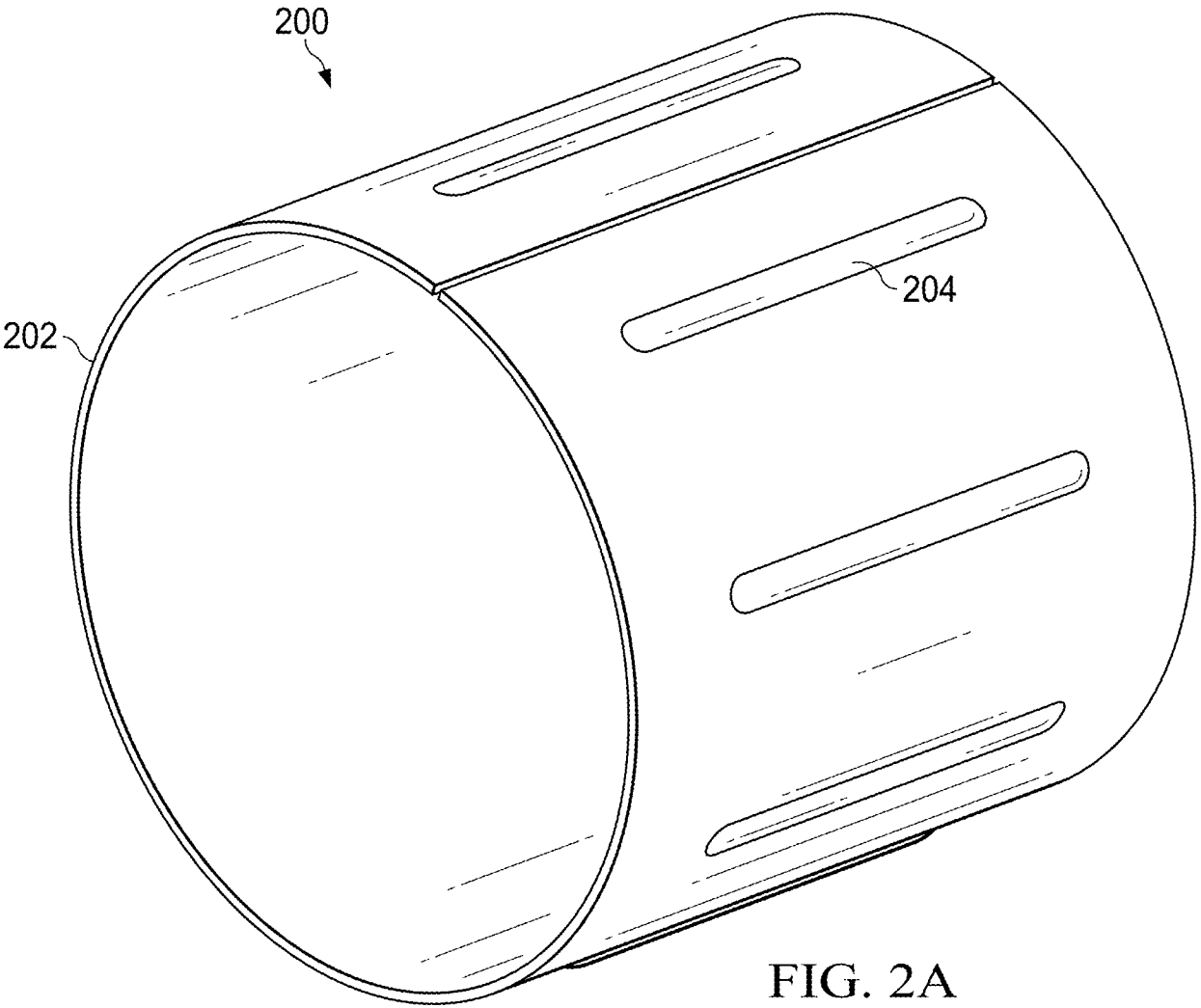
FIG. 2A is a perspective view of a downhole sleeve having a plurality of protrusions around a cylindrical housing of the downhole sleeve.

FIG. 2A is a perspective view of a downhole sleeve 200 having a plurality of protrusions including protrusion 204 around a cylindrical housing 202 of downhole sleeve 200. In the embodiment of FIG. 2A, the protrusions are rectangular shaped and are eventually distributed around cylindrical housing 202. In the embodiment of FIG. 2A, cylindrical housing 202 is fitted around another component, such as a magnet or magnetic array. In some embodiments, the protrusions have a different shape and/or a different distribution around cylindrical housing. Force/pressure applied to the exterior surfaces of the protrusions including protrusion 204 are transferred through the protrusions onto the component (such as magnet or magnetic array) to hold the component in position during downhole operations, and to prevent unwanted movement of the component during the downhole operations. In some embodiments, cylindrical housing 202 and the protrusions are formed from different materials to protect the structural integrity of downhole sleeve 200 during downhole operations while permitting sufficient transfer of force through the protrusions (onto the component), and avoiding damage to downhole sleeve 200 is deployed to hold in place.

Figure 2B:
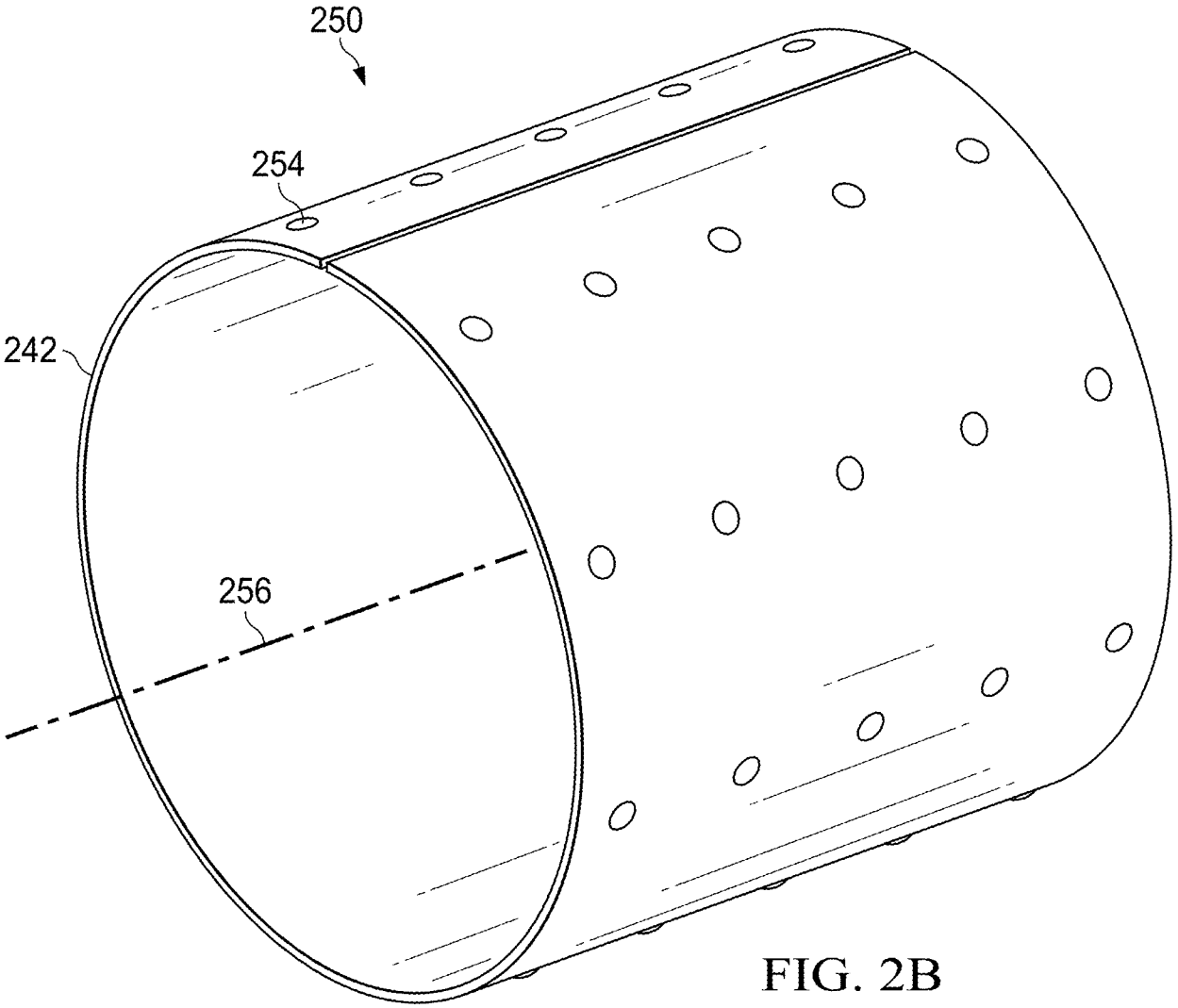
FIG. 2B is a perspective view of another downhole sleeve similar to the downhole sleeve of FIG. 2A.

FIG. 2B is a perspective view of another downhole sleeve 250 similar to downhole sleeve 200 of FIG. 2A. In the embodiment of FIG. 2B, the protrusions, including protrusion 254, are dome-shaped structures and are eventually distributed around cylindrical housing 242. In the embodiment of FIG. 2B, cylindrical housing 242 is fitted around another component, such as a magnet or magnetic array. In some embodiments, the protrusions have a different shape and/or a different distribution around cylindrical housing. Force/pressure applied to the exterior surfaces of the protrusions, including protrusion 254, are transferred through the protrusions radially-inward towards axis 256 and onto the component (such as magnet or magnetic array) to hold the component in position during downhole operations, and to prevent unwanted movement of the component during the downhole operations. In some embodiments, cylindrical housing 242 and the protrusions are formed from different materials to protect the structural integrity of downhole sleeve 250 during downhole operations while permitting sufficient transfer of force through the protrusions (onto the component), and avoiding damage to downhole sleeve 250 is deployed to hold in place.

Figure 3A:
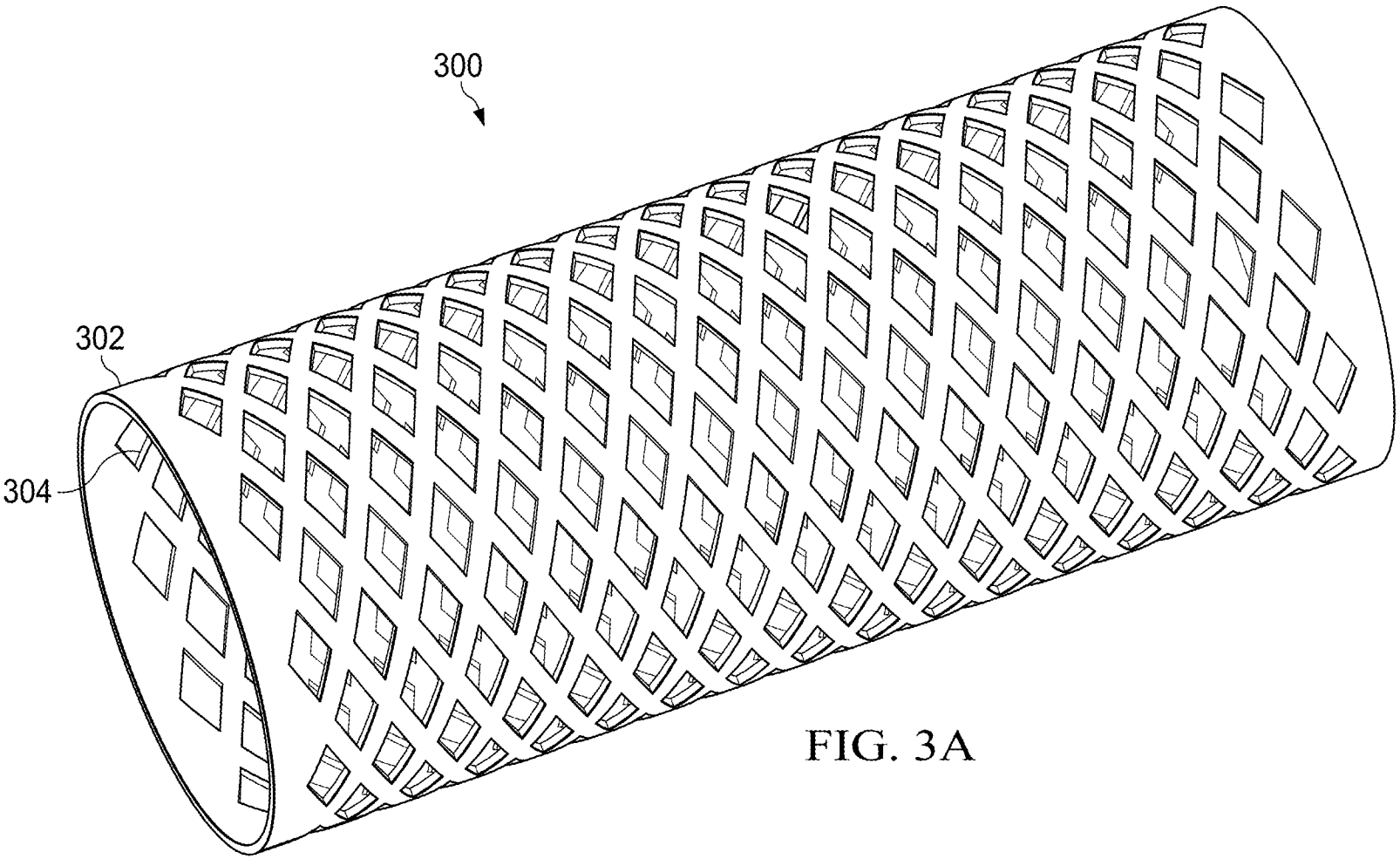
FIG. 3A is a perspective view of another downhole sleeve having an elastic body and a plurality of cutouts extending along a curved surface of the elastic body.

FIG. 3A is a perspective view of another downhole sleeve 300 having an elastic body 302 and a plurality of cutouts, including cutout 304, extending along a curved surface of elastic body 302. In the embodiment of FIG. 3A, elastic body 302 stretches radially outward when elastic body 302 is positioned around a component (e.g., magnet, magnetic array, etc.) to position downhole sleeve 300 around the component. Further, after elastic body 302 is positioned around the insert, elastic properties of elastic body 302 applies a radially-inward force, which in turn holds the component in place, such as to restrain the component to an insert while the component and insert experience downhole vibrations. In the embodiment of FIG. 3A, the cutouts are diamond shaped. In some embodiments, the cutouts are braid-like, or take on another shape to permit a magnet or another component secured by the downhole sleeve a degree of flexibility while securing the magnet or component.

Figure 3B:
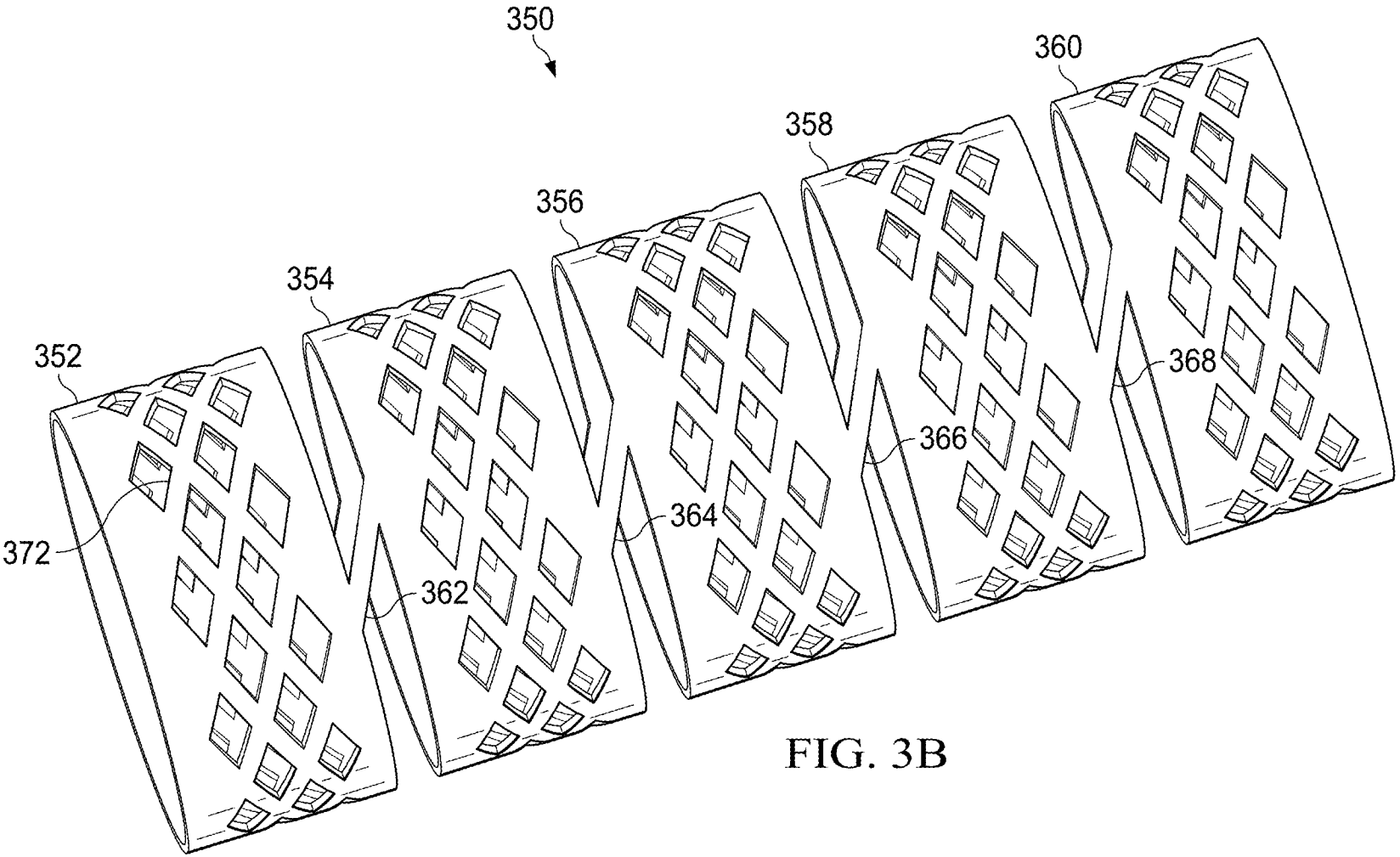
FIG. 3B is another downhole sleeve similar to the downhole sleeve of FIG. 3A.

FIG. 3B is another downhole sleeve 350 similar to downhole sleeve 300 of FIG. 3A. In the embodiment of FIG. 3B, downhole sleeve 350 is formed from five elastic bodies 352, 354, 356, 358, and 360 connected by bridges 362, 364, 366, and 368, respectively. Further, a plurality of cutouts, including cutout 372, are formed along elastic bodies 352, 354, 356, 358, and 360. In the embodiment of FIG. 3B, similar to the embodiment of FIG. 3A, the elastic properties of elastic bodies 352, 354, 356, 358, and 360 permit elastic bodies 352, 354, 356, 358, and 360 to stretch in radially outward directions to wrap around one or more components, and subsequently apply forces in radially-inward directions to hold the one or more components in place during downhole operations. Further, bridges 362, 364, 366, and 368 provide downhole sleeve 350 with additional flexibility during downhole operations to protect the one or more components during the downhole operations.

Figure 4A:
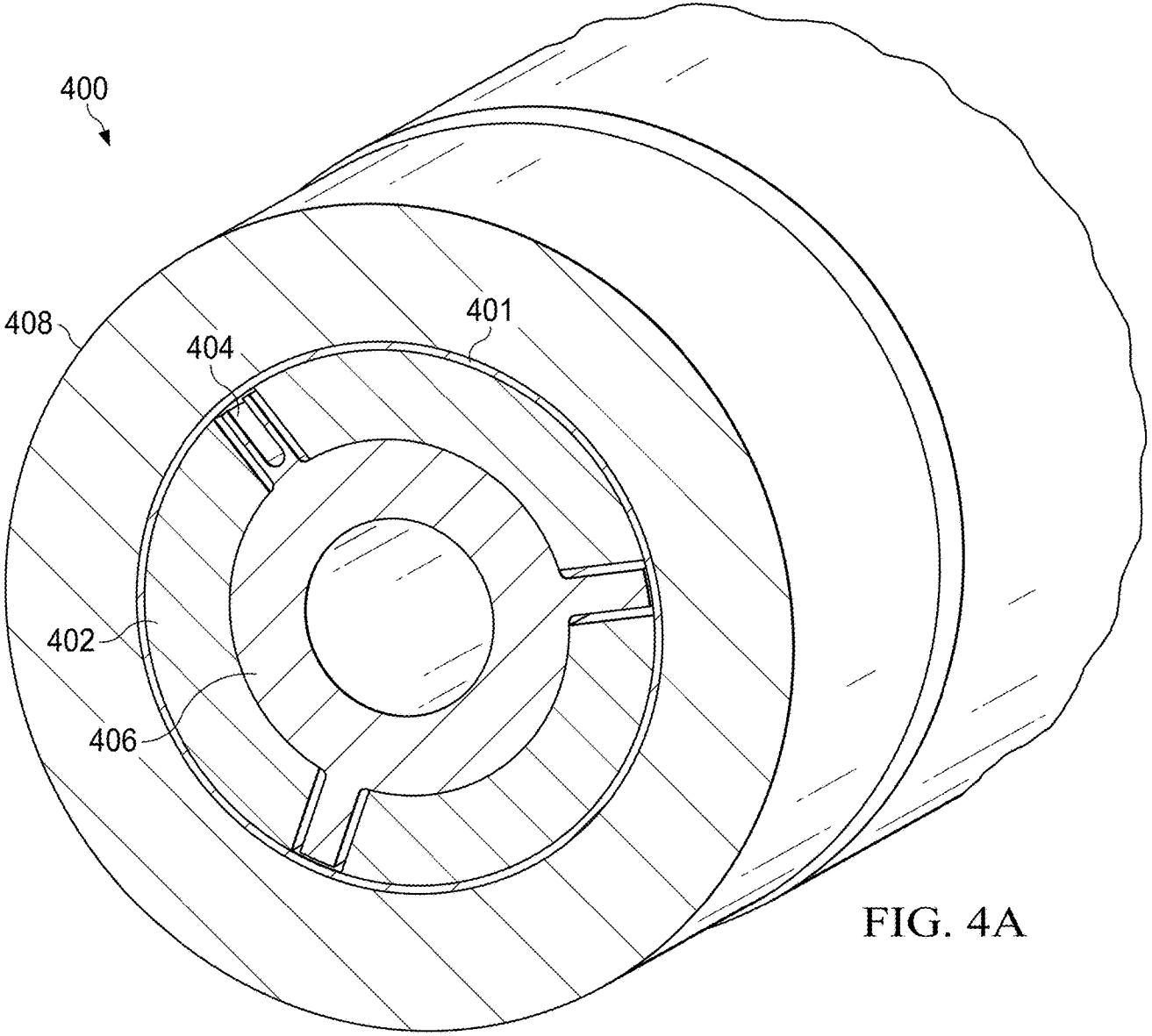
FIG. 4A is a cross-sectional view of a magnetic assembly having a downhole sleeve similar to the downhole sleeve of FIG. 2A.

FIG. 4A is a cross-sectional view of a magnetic assembly 400 having a downhole sleeve 401 similar to downhole sleeve 200 of FIG. 2A. In the embodiment of FIG. 4A, downhole sleeve 401 has a cylindrical body 402 that is positioned around a component 406 (e.g., magnet or magnetic array). Further, a ring (such as an o-ring), collet, or other device 408 is positioned around cylindrical body 402 such that force/pressure applied by ring, collet, or other device 408 is transferred to the protrusions of downhole sleeve 401, including protrusion 404, and through the protrusions onto component 406 to hold component 406 in place during downhole operations. Thus, the magnetic assembly 400 includes and/or is coupled to a ring, collet, or another device 408 configured to apply force/pressure to the protrusions, which are, in turn, transferred onto component 406 to hold component 406 in position during downhole operations.

Figure 4B:
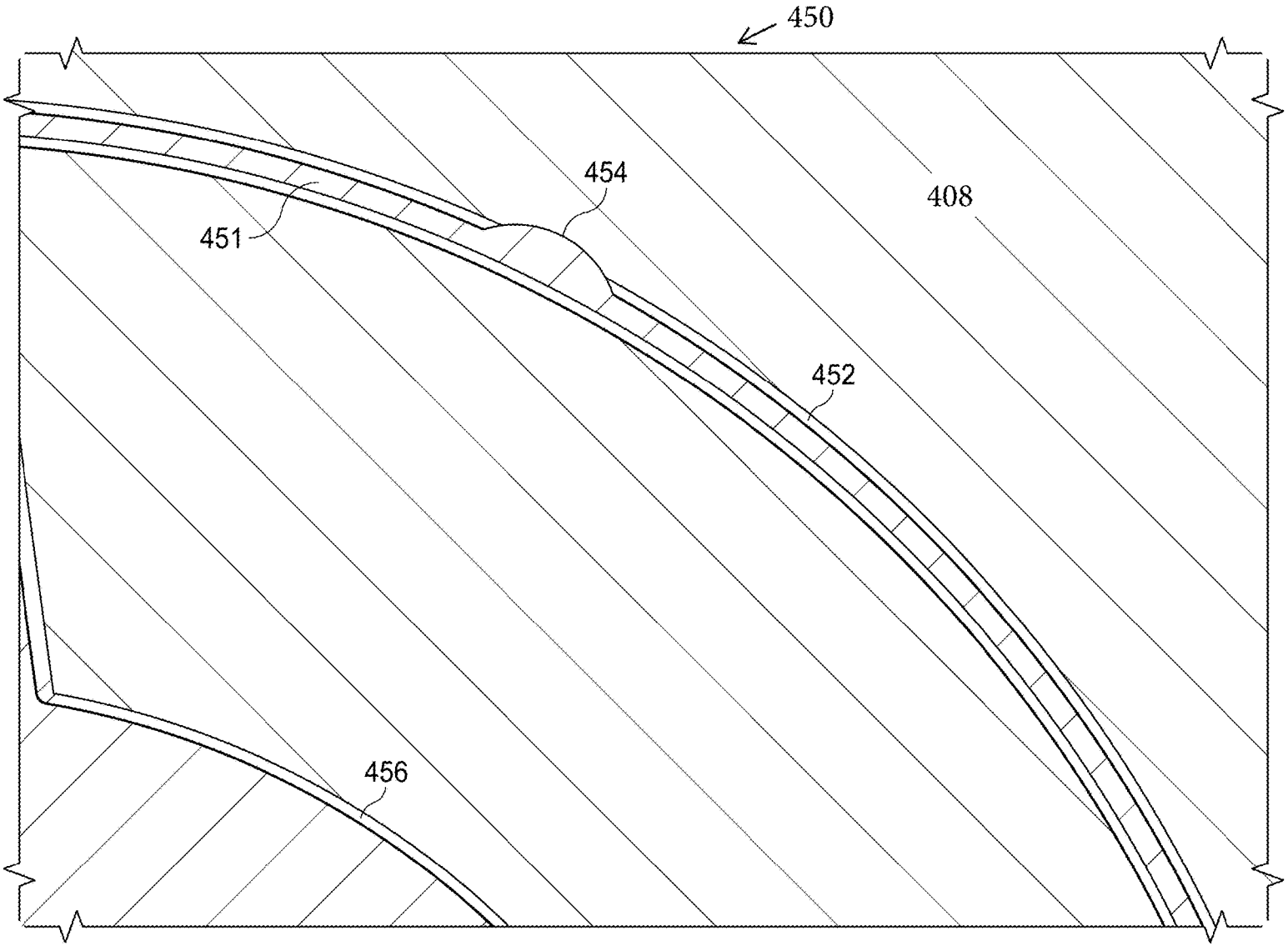
FIG. 4B is a cross-sectional view of another magnetic assembly having a downhole sleeve similar to the downhole sleeve of FIG. 2B.

FIG. 4B is a cross-sectional view of another magnetic assembly 450 having a downhole sleeve 451 similar to downhole sleeve 250 of FIG. 2B. In the embodiment of FIG. 4B, the protrusions including protrusion 454, are dome-shaped structures and are positioned across a cylindrical body 452 of downhole sleeve 451. In the embodiment of FIG. 4B, similar to the embodiment of FIG. 4A, force/pressure applied (e.g., by a ring, collet, or other device 408) onto the protrusions 454 is transferred through the protrusions 454 onto component 456 to hold component 456 in place during downhole operations.

Figure 5:
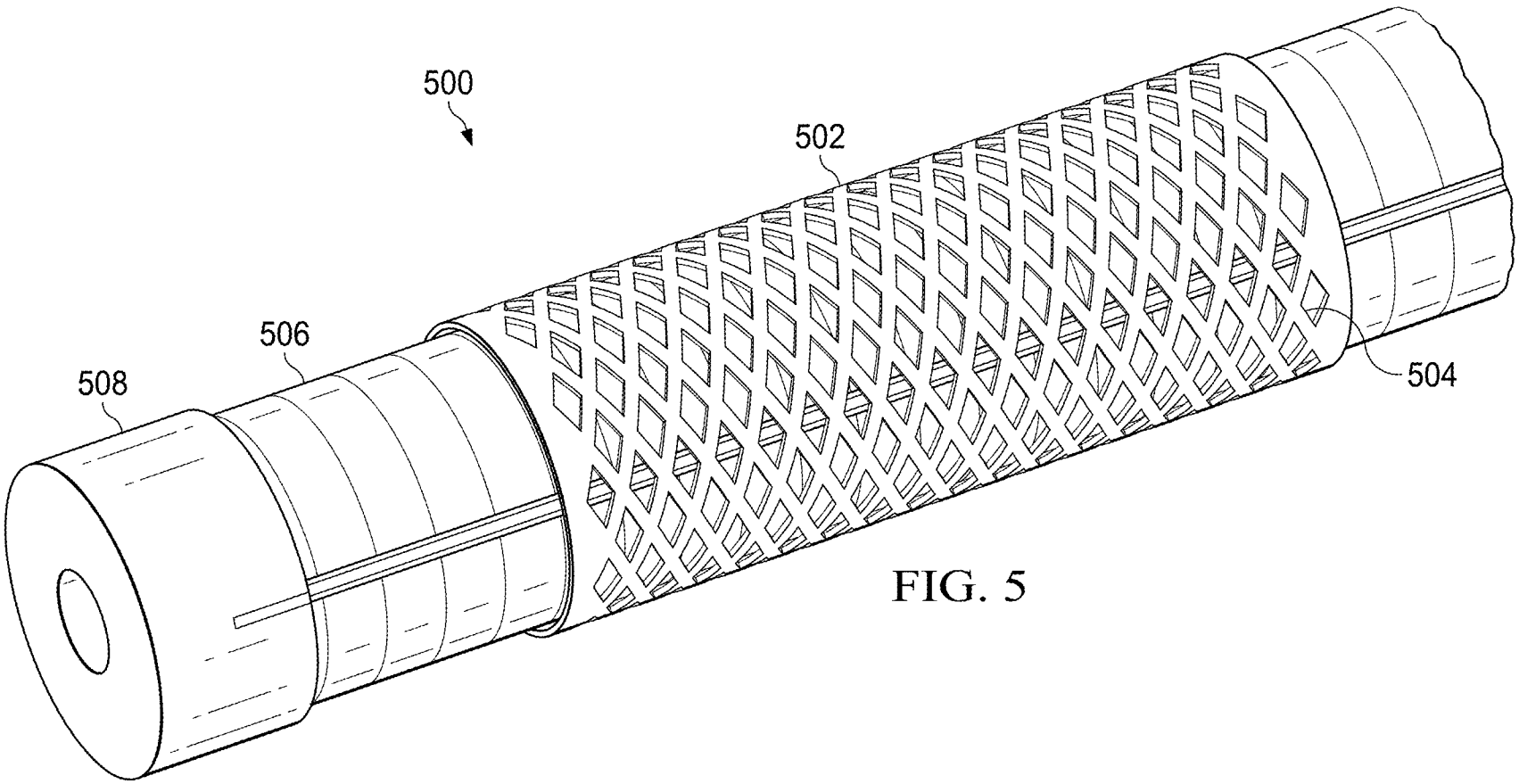
FIG. 5 is a perspective view of another magnetic assembly having a downhole sleeve similar to the downhole sleeve of FIG. 3A.

FIG. 5 is a perspective view of another magnetic assembly 500 having a downhole sleeve similar to the downhole sleeve of FIG. 3A. In the embodiment of FIG. 5, magnetic assembly 500 includes an insert 508 and a magnetic array 506. An elastic body 502 of a downhole sleeve is stretched radially outward to fit the downhole sleeve around insert 508 and magnetic array 506. After the downhole sleeve is in position, elastic properties of elastic body 502 applies a radially-inward force onto magnetic array 506 to "shrink-fit" magnetic array 506 with respect to insert 508, thereby preventing unwanted movement of magnetic array 506 during downhole operations. Further, cutouts including cutout 504 provide a degree of flexibility to magnetic array 506, thereby reducing damage to magnetic array 506 while holding magnetic array 506 in place during downhole operations.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a downhole sleeve, comprising: a cylindrical housing having a hollow interior, the cylindrical housing configured to slide around a component; and a plurality of protrusions positioned around the cylindrical housing, each protrusion configured to: receive a radially-inward force applied to an exterior surface of the respective protrusion; and transfer the radially-inward force through an interior surface of the respective protrusion to hold the component in position.

Clause 2, the downhole sleeve of clause 1, wherein the plurality of protrusions are ribs laterally positioned around the cylindrical housing.

Clause 3, the downhole sleeve of clauses 1 or 2, wherein the plurality of protrusions are dome-shaped structures positioned around the cylindrical housing.

Clause 4, the downhole sleeve of clauses 1-3, wherein the downhole component is a magnet, and wherein each protrusion is configured to transfer the radially-inward force applied to the exterior of surface of the respective protrusion onto the magnet to hold the magnet in place.

Clause 5, the downhole sleeve of clauses 1-4, wherein each protrusion is formed from a compressible material that permits transfer of the radially-inward force through the respective protrusion onto the component.

Clause 6, the downhole sleeve of clauses 1-5, wherein the cylindrical housing and the plurality of protrusions are formed from different materials.

Clause 7, downhole sleeve of clause 6, wherein the plurality of protrusions are formed form rubber, whereas the cylindrical housing is formed from a metal.

Clause 8, the downhole sleeve of clauses 1-7, wherein the cylindrical housing is configured to slide around a plurality of magnets positioned around an insert, and wherein a plurality of protrusions are configured to hold the plurality of magnets in position.

Clause 9, a downhole sleeve, comprising: an elastic body configured to: stretch radially outward to secure the downhole sleeve around an insert; and apply a radially-inward force after the downhole sleeve is secured around the insert; and a plurality of cutouts extending along a curved surface of the elastic body.

Clause 10, the downhole sleeve of clause 9, wherein the downhole sleeve is configured to apply the radially-inward force onto a magnet that is mounted on the insert to secure the magnet.

Clause 11, the downhole sleeve of clause 10, wherein the elastic body is configured to hold the magnet in position during a downhole operation.

Clause 12, the downhole sleeve of clause 11, wherein the downhole sleeve is configured to restrain the magnet to the insert while the magnet and insert experience downhole vibrations.

Clause 13, the downhole sleeve of clauses 9-12, wherein the plurality of cutouts have diamond shapes.

Clause 14, the downhole sleeve of clauses 9-13, wherein the plurality of cutouts are configured to permit a magnet secured by the downhole sleeve a degree of flexibility while securing the magnet to the insert.

Clause 15, the downhole sleeve of clauses 9-14, wherein the plurality of cutouts are configured to reduce a stiffness of the downhole sleeve.

Clause 16, the downhole sleeve of clauses 9-15, wherein the plurality of cutouts are configured to reduce a rigidity of the downhole sleeve.

Clause 17, a magnetic assembly, comprising: a magnet; and a downhole sleeve comprising: a cylindrical housing having a hollow interior, the cylindrical housing configured to slide around the magnet; and a plurality of protrusions positioned around the cylindrical housing, each protrusion configured to: receive a radially-inward force applied to an exterior surface of the respective protrusion; and transfer the radially-inward force through an interior surface of the respective protrusion to hold the magnet in position.

Clause 18, the magnetic assembly of clause 17, further comprising a collet positioned around the cylindrical housing and configured to apply the radially-inward force onto a plurality of protrusions.

Clause 19, the magnetic assembly of clauses 17 or 18, wherein the plurality of protrusions are ribs laterally positioned around the cylindrical housing.

Clause 20, the magnetic assembly of clauses 17-19, wherein the plurality of protrusions are dome-shaped structures positioned around the cylindrical housing.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole sleeve comprising:

a cylindrical housing having a hollow interior, wherein the cylindrical housing is configured to slide around a component comprising a magnet; and a plurality of protrusions positioned around the cylindrical housing, each protrusion being configured to:

receive a radially-inward force applied to an exterior surface of the respective protrusion; and transfer the radially-inward force through an interior surface of the respective protrusion onto the component to hold the component in position; and a collet positioned around the cylindrical housing and configured to apply the radially-inward force on the plurality of protrusions.

2. The downhole sleeve of claim 1, wherein the plurality of protrusions are ribs laterally positioned around the cylindrical housing.

3. The downhole sleeve of claim 1, wherein the plurality of protrusions are dome-shaped structures positioned around the cylindrical housing.

4. The downhole sleeve of claim 1, wherein each protrusion is formed from a compressible material that transfers the radially-inward force through the respective protrusion to the component.

5. The downhole sleeve of claim 1, wherein the cylindrical housing and the plurality of protrusions are formed of different materials.

6. The downhole sleeve of claim 5, wherein the plurality of protrusions are formed of rubber, and the cylindrical housing is formed of a metal.

7. The downhole sleeve of claim 1, wherein the component includes a plurality of magnets positioned around an insert, wherein the cylindrical housing is configured to slide around the plurality of magnets positioned around the insert, and wherein a plurality of protrusions are configured to hold the plurality of magnets in position around the insert.

8. A downhole sleeve comprising:

an elastic body having a curved surface that defines an interior and being configured to:

stretch radially outward to secure the downhole sleeve around an insert positioned within the interior; and apply a radially-inward force to the insert after the downhole sleeve is secured around the insert, wherein the radially-inward force restrains movement of the insert and a component mounted on the insert, the component comprising a magnet included in the interior of the elastic body; and a plurality of cutouts extending along the curved surface of the elastic body positioned to enable the insert secured by the downhole sleeve to move with a degree of flexibility while the component and the insert are subjected to vibration.

9. The downhole sleeve of claim 8, wherein the downhole sleeve is configured to restrain the magnet to the insert while the magnet and insert are subjected to downhole vibrations.

10. The downhole sleeve of claim 8, wherein each of the plurality of cutouts are in a diamond shape.

11. The downhole sleeve of claim 8, wherein each of the plurality of cutouts are configured to enable the magnet secured by the downhole sleeve to move with a degree of flexibility while the magnet is secured in position relative to the insert.

12. The downhole sleeve of claim 8, wherein the plurality of cutouts are configured to reduce a stiffness of the downhole sleeve.

13. The downhole sleeve of claim 8, wherein the plurality of cutouts are configured to reduce a rigidity of the downhole sleeve.

14. A magnetic assembly comprising:

a magnet; and a downhole sleeve comprising:

a cylindrical housing having a hollow interior, the cylindrical housing configured to slide around the magnet;

a plurality of protrusions positioned around the cylindrical housing, each protrusion configured to:

receive a radially-inward force applied to an exterior surface of the respective protrusion; and transfer the radially-inward force through an interior surface of the respective protrusion to hold the magnet in position; and a collet positioned around the cylindrical housing and configured to apply the radially-inward force on the plurality of protrusions.

15. The magnetic assembly of claim 14, wherein the plurality of protrusions are ribs laterally positioned around the cylindrical housing.

16. The magnetic assembly of claim 14, wherein the plurality of protrusions are dome-shaped structures positioned around the cylindrical housing.

* * * * *